United States Patent [19]

Rogers

[11] Patent Number: 4,852,451

[45] Date of Patent: Aug. 1, 1989

[54] POWDER LEVEL SENSING DEVICE

[76] Inventor: Ronald O. Rogers, 11932 La Cima, La Mirada, Calif. 90638

[21] Appl. No.: 266,105

[22] Filed: Nov. 2, 1988

[51] Int. Cl.[4] ..... F42B 33/02

[52] U.S. Cl. ..... 86/33; 86/23; 86/25; 86/27; 86/29; 86/30; 86/31; 86/43; 73/149; 73/167; 73/866.5

[58] Field of Search ..... 86/23, 27, 29, 30, 31, 86/33, 47; 73/149, 167

[56] References Cited

U.S. PATENT DOCUMENTS

| | | | |
|---|---|---|---|
| 3,019,688 | 2/1962 | Hunt | 86/31 |
| 3,656,518 | 4/1972 | Aronson | 86/31 |
| 4,127,054 | 11/1978 | Gully | 86/23 |
| 4,292,877 | 10/1981 | Lee | 86/31 |
| 4,295,409 | 10/1981 | Simpson | 86/31 |

OTHER PUBLICATIONS

Operation Manual, "Hornady Pro-7 Progressive Reloading Press", (16 pgs.).

*Primary Examiner*—Howard J. Locker

*Attorney, Agent, or Firm*—Knobbe, Martens, Olson & Bear

[57] ABSTRACT

Disclosed is a device for sensing the powder level within a cartridge shell during the reloading process comprising a housing having a ramp in its interior, a sleeve slidably inserted within the housing having a radial hole initially positioned below the ramp in which resides a ball, and a plunger inserted within the sleeve having a groove for receipt of the ball. A probe is mounted on the lower end of the plunger which contacts the powder deposited in the cartridge shell, wherein the probe lifts the plunger so that the groove in the plunger may receive the ball upon the presence of a proper amount of powder so the sleeve can slide upward into the housing allowing the cartridge to enter the housing. Preferably, the powder level sensing device is adapted to be mounted onto existing reloading press frames, particularly the progressive reloading press frame. Also disclosed is a method for adjusting the powder level sensing device to accommodate various cartridge shells and desired powder levels.

20 Claims, 2 Drawing Sheets

POWDER LEVEL SENSING DEVICE

BACKGROUND

The present invention relates to ammunition reloading presses which refill cartridge shells for reuse, particularly to an apparatus for use in such presses which alerts the operator of an improperly loaded cartridge shell.

Gun enthusiasts have long been using various types of manually operated reloading presses to get many uses from a single cartridge shell. The manual reloading process saves the gun enthusiasts the costs of buying new ammunition. Moreover, the process can be done using relatively inexpensive equipment at the operator's convenience. Frequently, operators reload cartridge shells at the same location where the gun firing is taking place.

The reloading process involves several principal operations. Those operations include (1) sizing, depriming and repriming; (2) belling or flaring the cartridge mouth; (3) dropping the powder into the cartridge shell; (4) seating the bullet onto the cartridge shell; and (5) crimping the cartridge about the bullet. Reloading presses which perform one operation at a time to a single cartridge shell are known as single stage reloaders. One such device is the Lee Reloader, manufactured by Lee Precision, Inc. of Hartford, Wisconsin. Those presses which perform several operations simultaneously to different cartridge shells are commonly referred to as progressive reloading presses. For example, two popular progressive reloading presses are the Hornady Pro 7, manufactured by the Hornady Manufacturing Co. of Grand Island, Neb., and the Dillon RL-450, manufactured by Dillon Precision Products, Inc. of Scottsdale, Ariz.

The progressive reloading presses have become increasingly popular in recent years primarily due to the increased speed at which they fully reload cartridges compared to the single stage presses. Unfortunately, the user has several operations over which he must monitor. Inevitably, the user fails to detect an intermittent malfunction of the powder measure as he gets distracted by other malfunctions on the reloading press. As a result, the possibility exists that a cartridge will get charged twice or not at all, both situations creating serious safety hazards. Empty cartridges result from either a jam in the powder measure or an early advance of the shell plate before the powder has been deposited. Such conditions create a squib load, which can leave a bullet in the barrel of the gun. If that misfire goes unnoticed, the next firing can rupture the barrel posing a serious threat to those around the firing activity. Overly filled cartridge shells occur frequently when the powder measure drops two loads of powder into the shell resulting in a potentially dangerous explosion. Thus, there exists the need for an apparatus which would immediately detect the presence of an improperly loaded cartridge during the reloading process so that the condition can be corrected before the shell completes the reloading process. That improper condition could be either the overfilling or underfilling of a cartridge shell with powder.

The prior art discloses two devices for detecting improperly loaded cartridge shells in automatic loading of new cartridge shells. The devices are the subjects of U.S. Pat. Nos. 3,019,688 to Hunt and 4,127,054 to Gully.

The Hunt patent discloses the use of pressuresensitive paper. Pins enter the powder loaded cartridge and, after a press stroke, the other end of the pin makes a definite clear-cut impression in the paper indicating to the user that the cartridge has a sufficient amount of powder. An indefinite or partial impression in the paper indicates that the cartridge position under that impression was filled with too little powder. Nothing in the patent discloses how to detect an overly filled cartridge.

The invention disclosed in the patent to Gully uses magnetic probes to detect low or missing powder charges. When the probe drops too low, the magnetic probe repels a second magnet outwardly preventing the loading plate from being separated from the holding plate. At that time, the operator would know of a low or missing charge among the cartridges. No method is disclosed for detecting overly filled cartridges.

Thus, there remains the need for a simple sensing device which alerts the operator of an improperly powdercharged cartridge. Particularly, with the ever increasing popularity of the progressive reloading press, there is a need for an early detection system which would eliminate the possibility of a doubly charged or uncharged cartridge. Preferably, the device would immediately cease all reloading functions upon the presence of an improperly loaded cartridge whether the cartridge has too little or too much powder within the cartridge shell, so that the faulty condition can be corrected. Moreover, preferably the device could be used on existing presses.

SUMMARY OF THE INVENTION

The present invention is an apparatus for detecting the presence of an insufficient or excessive amount of powder deposited in a cartridge shell and for preventing an improperly loaded cartridge shell from completing the reloading process. The present invention has a means for measuring the quantity of powder which has been deposited in the cartridge shell and a means for comparing the measured quantity with the predetermined quantity. Also, there is provided a means for stopping the reloading process when the quantity of powder is not equal to the predetermined amount, whether the amount deposited and measured is insufficient or excessive.

A preferred embodiment has a housing adaptable to be mounted on a reloading press frame having upper and lower sections where the upper section has an interior cross-sectional area less than the interior cross-sectional area at the lower section, and the point proximate to the change of the two cross-sectional areas is a downwardly facing ramp. A sleeve slidably inserted within the housing has a hole extending radially which is at least partially below the ramp when the sleeve is in its initial position. A plunger is slidably inserted within the sleeve and a probe is mounted on the lower end of said plunger. A ball within the radial hole has a diameter such that it protrudes beyond the exterior surface of the sleeve when against the plunger and when the sleeve is in its initial position. The ball is also dimensioned so that when the probe and sleeve are in proper relative positions with respect to each other upon the presence of a properly powder-filled cartridge shell, the ramp will force the ball toward a groove on the exterior of the plunger so that the sleeve can move upward with the probe and plunger, as the cartridge shell contacts and forces upwardly the sleeve. Moreover, the relationship of the aforementioned parts is such that when the probe and sleeve are not in proper relative positions, the ball cannot move toward the groove and thus is positioned against the housing ramp so that the sleeve remains in its initial position, thus preventing the entrance of the cartridge shell into the housing.

In a preferred embodiment, the housing has a collar which laterally supports the plunger. In another, a snap ring is mounted to the lower end of the housing to retain the sleeve within the housing. A spring clip is mounted about the plunger so that it contacts the top of the sleeve thus preventing the plunger from sliding out of the housing and sleeve.

In another preferred embodiment, a coil spring is positioned between the sleeve and the housing to assist the sleeve in returning to its initial position. In another, the probe is able to fit within the housing and sleeve upon the presence of excessive powder levels. Also, a locking nut is screwed on the exterior of the housing so that it may press against the reloader's press frame to prevent undesirable vertical movement.

Further objects, features and advantages of the present invention will become apparent from the detail description of the preferred embodiment which follows, when considered together with the attached figures and claims.

DETAILED DESCRIPTION OF THE PREFERRED EMBODIMENTS

Figure 1:
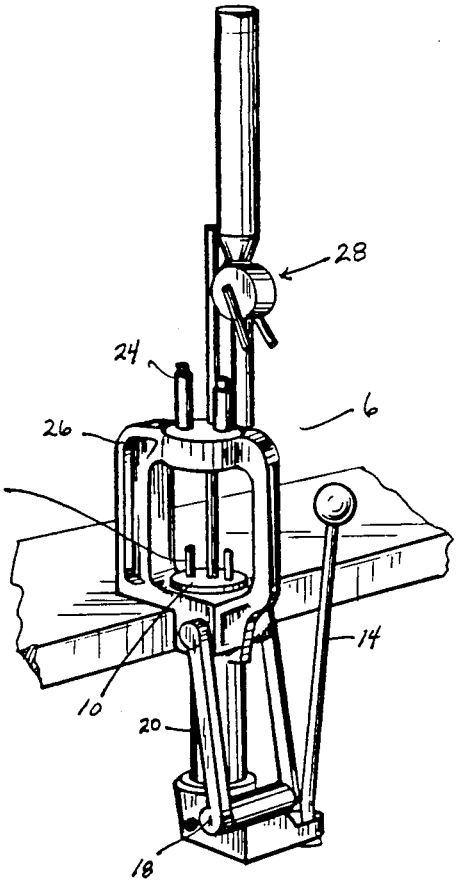
FIG. 1 is a perspective view of a progressive reloading press.

In FIG. 1, there is illustrated a manual progressive reloading press 6, the basic understanding of which is essential to an appreciation of the present invention. Though the present invention has equal applicability to the single station reloader, FIG. 1 represents any progressive multistation press which provides what is believed to be the most advantageous way to use the present invention. In particular, the foregoing discussion presumes the use of a five station progressive press such as the Hornady Pro 7, the operation of which is understood by those skilled in the art.

Once the reloading press is fully adjusted to accommodate the particular cartridge shell to be reloaded and all stations are filled with the proper materials, the operator places a cartridge 8 in position on a shell holder plate 10. The operator pulls down on an operating handle 14 which causes a compound linkage 18 to force up a drive shaft or ram 20. Because the shell holder plate 10 is attached to the upper end of the drive shaft 20, the cartridge shell 8 is raised upward and into one of the dies 24 where a stage of the reloading process takes place. As the operating handle 14 is moved, the shell holder plate 10 rotates so that each cartridge shell advances to a position beneath the next station. With a cartridge shell 8 at each position on the shell holder plate 10, each complete stroke or cycle of the operating handle 14 produces a loaded round.

A progressive reloading press performs several steps at different stations simultaneously with different cartridge shells. The steps can be generally categorized as the following: (1) sizing, and depriming; (2) belling or flaring the cartridge mouth; (3) dropping the powder into the shell cartridge; (4) seating the bullet onto the cartridge shell; and (5) crimping the cartridge about the bullet. On the Hornady Pro-7, the cartridge shell is reprimed as the operating handle 14 completes its cycle (as it is being pulled upwardly). The sensing device of the present invention would be used after the dropping of the powder and before the seating of the bullet, whether those operations are done on a single stage press or a progressive press. The present invention may add another step to the reloading press so it is preferred that a five stage progressive press be used, which can dedicate a station for the sensing operation. However, because the sensing device of the present invention can be easily combined with the step involving the powder dropper 28, a four stage progressive press can also be used, such as the RL-550 manufactured by Dillon Precision Products, Inc.

Alternatively, if a four stage press is used, it may be necessary to use a powder-thru neck expanding powder measure such as that provided by Dillon with the RL-550. Also, it may be necessary to use a combined bullet seating and crimp die in order to make available a station for mounting the present invention. With a five stage press, such as the Hornady Pro-7, there are enough stations provided so that either a separate taper crimp die or neck expanding die can be accommodated.

Figure 2:
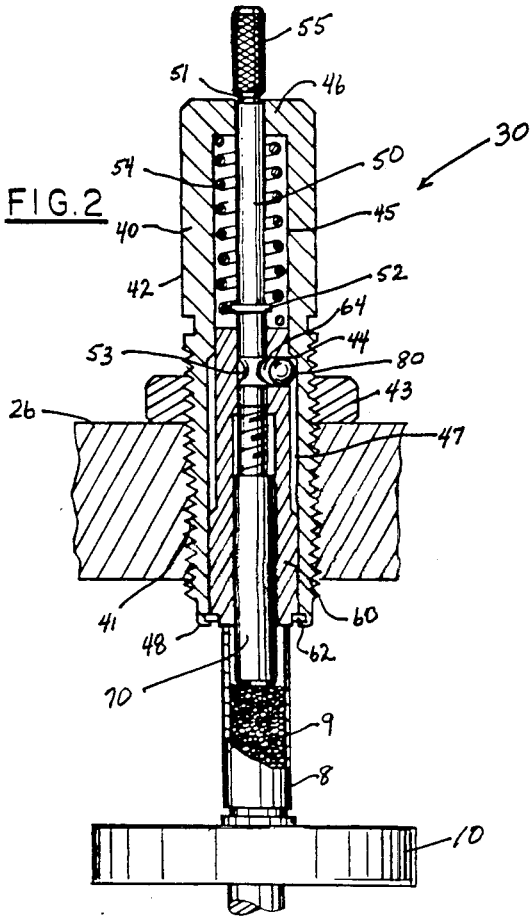
FIG. 2 is a cross-sectional view of the powder detector of the present invention in operation with a properly loaded cartridge.
Figure 3:
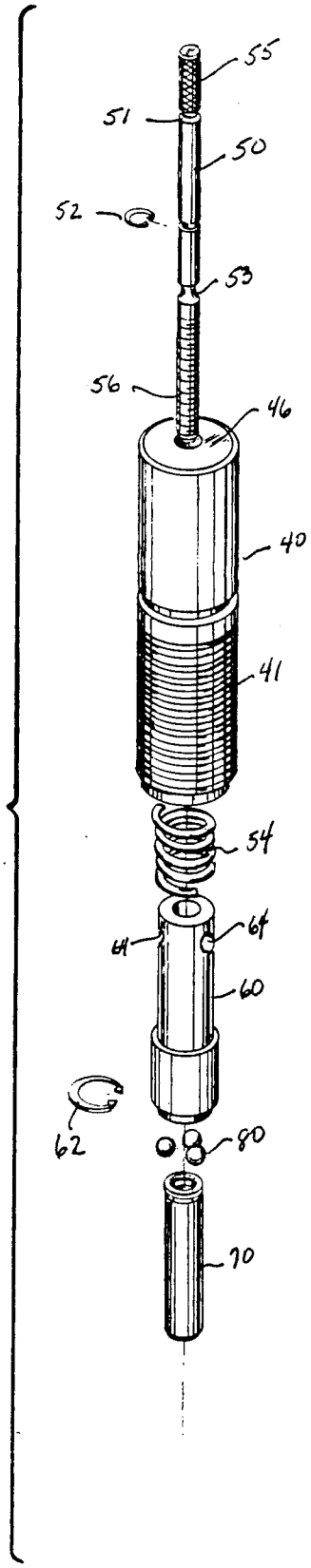
FIG. 3 is an exploded perspective view of the main components of the powder detector of FIGS. 2 and 2*a*.

The sensing device of the present invention is affixed to the reloading press frame 26 just as are the dies 24 in a conventional reloading press 6. As depicted in FIGS. 2 and 3, the principal components of the sensing device 30 are a housing 40, a plunger 50, a locking sleeve 60, a probe 70, and a plurality of locking balls 80. It is understood that the plunger 50 and probe 70 may be one piece although some adjustability is lost by combining them.

The housing 40, preferably machined from high carbon steel and heat treated, is an elongated, tubular member having a threaded exterior portion 41 so that it may be attached to the press frame 26. Thus, preferably the thread is a standard $\frac{7}{8}$–14 thread, as used on most reloading dies. To facilitate turning the housing for attachment and adjustment, an upper exterior section 42 is either diamond knurled or hexagonal to accommodate a wrench. Once vertically adjusted, a locking nut 43, threaded to mate with the exterior of the housing 40, is positioned against the top face of press frame 26 as shown in FIGS. 2, 2*a*, 4 and 5.

The interior bore of the housing preferably has an upper interior portion 45 having a diameter smaller than that of a lower interior portion 47. At the juncture where the change in diameter occurs, there is a downwardly facing annular shoulder or ramp 44. For example, assuming the upper and lower portions 45, 47, were of equal length, the ramp would be located midway between the housing lower lip 48 and the housing collar 46.

The housing collar 46 laterally supports plunger 50, and allows the plunger to slide therethrough. The top end of plunger 50 preferably extends upward beyond the housing collar 46 so that it may visually indicate to the operator an improperly loaded cartridge. To facilitate that visual indication, the probe may have an index groove 51 which would be level with the top surface of the housing collar 46 when the present invention is engaged with a properly loaded cartridge as shown in FIG. 2. The index groove 51 also aids the operator in properly adjusting the plunger 50, as will be shown.

Preferably, a portion 55 near the top end of the plunger 50 is diamond knurled so that the plunger may be more easily adjusted vertically within probe 70 which is mounted on the lower end of plunger 50. Thus, preferably a portion 56 near the lower end is threaded to accommodate the probe 70. The probe 70 is screwed up or down as necessary during assembly to match the desired powder level. Preferably the probe 70 is made of aluminum, or any other material which minimizes sparking. The probe 70 is the only part of the present invention which contacts the powder 9.

To ensure that the probe 70 does not move or "creep" relative to the plunger 50 during operation, a spring clip (not shown) can be positioned inside a slot cut in the interior of the probe 70. It will bear against the threads at 56 to prevent that undesired relative movement. Another arrangement to prevent creeping is to have a hole (not shown) drilled through the plunger 50 near its lower end. Within the hole is a short piece of elastomer material (not shown). The length of this material will cause it to exert outward forces onto the threads on the interior diameter of the probe 70 so that the two pieces are held firmly in registration.

Figure 4:
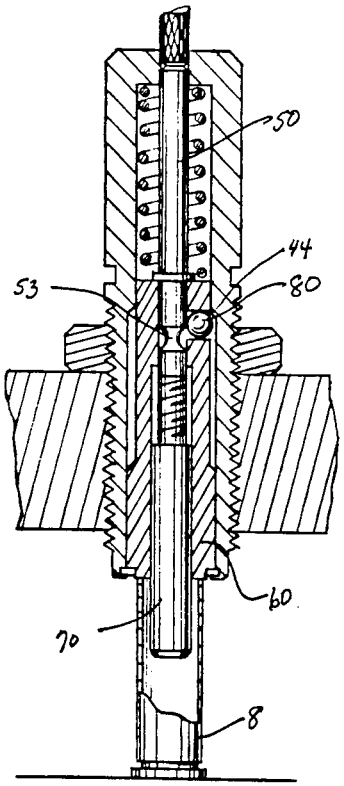
FIG. 4 is a cross-sectional view of the detector of the present invention preventing the insertion of an underfilled cartridge.
Figure 5:
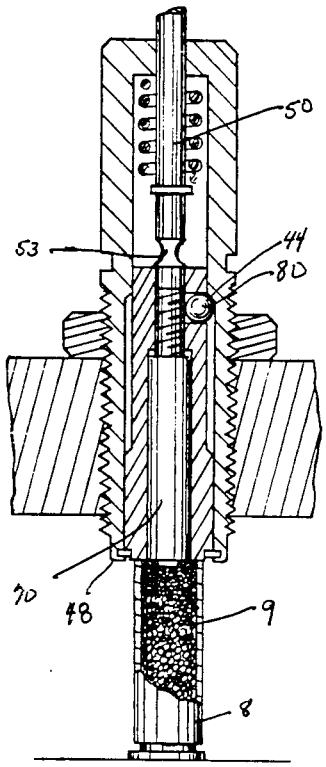
FIG. 5 is a cross-sectional view of the detector of the present invention preventing the insertion of an overly filled cartridge.

Within the housing 40 and about the plunger 50 and the probe 70 is a locking sleeve 60. The locking sleeve 60 can be made from aluminum, steel or like materials. It is understood that the material would be selected based upon their machinability and bearing qualities and the need to eliminate any possibility of sparking. It is retained within the housing 40 by a snap ring 62 which resides in a slot machined inside the lower lip 48 of the housing 40. In its initial position, the locking sleeve rests on snap ring 62 as is shown in FIGS. 2, 4, and 5. The exterior dimension of the locking sleeve 60 should be such that it is free to slide upward within the housing 40. Preferably, the length of the locking sleeve 60 allows it to slide upward enough so that a cartridge shell can be placed beneath the locking sleeve and almost completely within housing 40. The interior of the locking sleeve 60 should snugly fit about the plunger 50, except for the portion about the threaded portion of the plunger. Thus, preferably the probe 70 could fit entirely within the locking sleeve when the probe 70 contacts an overly filled cartridge as shown in FIG. 5. Preferably, a coiled spring 54 is placed within the housing 40 above the locking sleeve 60 to ensure the locking sleeve returns to its lowermost position notwithstanding the possible presence of drag caused by dirt on the mating surfaces between the housing 40 and the locking sleeve 60.

About the plunger 50 is a spring clip 52 which prevents the plunger and probe 70 from sliding downwardly out of the locking sleeve 60. When the plunger 50 and probe 70 are in their lowermost position, the spring clip 52 will rest on the top surface of the locking sleeve 60. Preferably the coil spring 54 will occupy the outer portion of that surface so that the spring clip 52 may contact the inner portion. The spring clip 52 also prevents the plunger 50 from sliding out through the housing collar 46 when the probe 70 is not attached to the plunger 50. The plunger 50 has an annular groove 53, with a semi-circular cross-section, which is located below the location where the spring clip 52 is attached.

The locking sleeve 60 has a plurality of radial holes 64 in which are positioned locking balls 80. When more than one locking ball 80 is to be used, the radial holes are preferably evenly spaced circumferentially. For example, three radial holes should be approximately 120° apart. Preferably, the locking balls 80 are made of stainless steel. The diameter of the locking balls 80 is greater than the distance between the inner and outer surfaces of the locking sleeve 60. The locking balls are small enough to partially enter the annular groove 53 within plunger 50. Thus, at any time during the operation of the present invention when the radial holes 64 are not aligned with the groove 53, the locking balls 80 must protrude beyond the outer surface of the locking sleeve 60. At those times, the radial holes 64 cannot rise above the ramp 44. It is understood that, as long as the locking sleeve 60 is prevented from moving upwardly, the locking balls 80 can be any other wedge or metal object to push against ramp 44. In the absence of a locking ball 80, the locking sleeve 60 is free to move axially within the housing 40.

The method of using the present invention will now be illustrated which will clarify the relationship of the aforementioned parts. First, of course, the present invention is mounted to the reloading press frame 26 exactly as are the reloading dies 24. Its adjustment relative to the press frame 26 is maintained by a lock nut 43. When the operator is satisfied that the vertical adjustment of the housing relative to the frame is correct, the lock nut 43 is rotated until it is tightly pressed against the upper surface of the press frame 26.

Figure 2A:
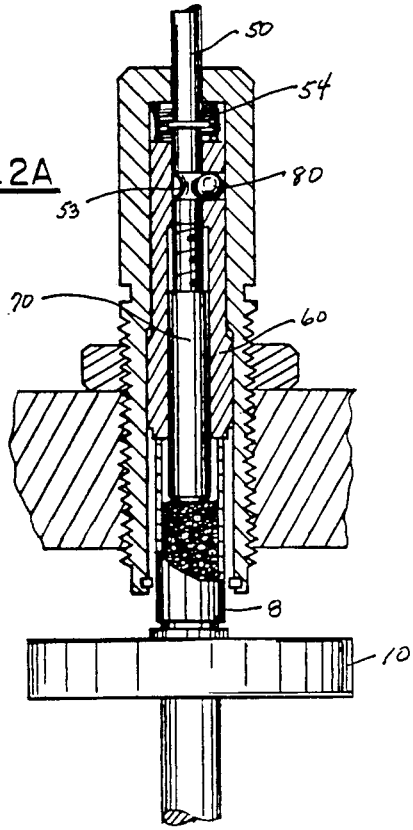
FIG. 2*a* is a cross-sectional view of the apparatus of FIG. 2 as the properly loaded cartridge is inserted into the housing.

A properly trimmed and charged cartridge case is mounted on the shell holder plate 10. By pulling the operating handle 14 downwardly, the ram 20 is raised to the point that the cartridge 8 makes contact with the bottom surface of the locking sleeve 60. In the case of a properly loaded cartridge, as illustrated in FIG. 2, the probe 70 comes into contact with the powder 9. It is raised by the powder 9 so that the groove 53 in the plunger 50 is aligned with the radial holes 64 of the locking sleeve 60. The upward motion of the locking sleeve 60 forces the locking balls 80 against the ramp 44, which, in turn, forces the balls 80 into the circular groove 53. The locking balls 80 and the ramp 44 act as detent means such that further upward motion of the cartridge 8 lifts the locking sleeve 60 and plunger 50 as a unit. Because the ramp 44 and the upper interior surface 45 of the housing 40 do not allow the locking balls 80 to protrude beyond the outer surface of the locking sleeve 60, and the locking balls 80 are snugly fit about and proximate the groove 53, the plunger 50 and the locking sleeve 60 remain as a unit as the drive shaft or ram 20 pushes the cartridge shell 8 upward as depicted in FIG. 2*a*. The operator can easily feel that the operating handle 14 may complete an entire cycle, and thus knows that the cartridge 8 has a proper amount of powder 9.

As the operator nears completion of the stroke of the operating handle 14, the ram 20 moves downward and the locking sleeve 60 will return to its initial or lowermost position as shown in FIG. 2. In the preferred embodiment, the locking sleeve would return onto the snap ring 62 assisted by a coil spring 54. Further downward motion of the ram 20 pulls the cartridge away from the locking sleeve 60. The weight of the probe 70 and the plunger 50 force the locking balls 80 outward to their initial position below the ramp 44. Motion ceases when the spring clip 52 rests on the top surface of the locking sleeve 60. The operation of a properly loaded cartridge does not effect the operation of the press at all and its presence under these circumstances will go unnoticed.

The operation of the present invention will be more fully understood when it encounters an underfilled cartridge shell, as shown in FIG. 4, when detecting the presence of an overly filled cartridge shell, as in FIG. 5.

In FIG. 4, the cartridge shell 8 has come into contact with the lower surface of the locking sleeve 60. However, the reloading cycle will be abruptly interrupted because the cartridge shell 8 cannot be moved upwardly into the housing 40. This condition is created because the probe 70 and plunger 50 drop in the absence of sufficient powder 9 within the cartridge shell 8. As a result, the groove 53 in the plunger 50 is below the level of the radial holes 64 in the locking sleeve 60. As a result, the locking balls 80 cannot enter the groove 53; and when forced inward by the ramp 44, the locking balls 80 engage the plunger 50, and thus continue to protrude beyond the outer surface of the locking sleeve 60. Therefore, the sleeve and its radial holes 64 cannot rise above the level of the ramp 44 and in turn, they prevent any further movement of the cartridge shell 8 into the housing 40. By stopping the cartridge shell 8 at that point, the operating handle 14 will be interrupted during its cycle. The operator will then know of the presence of an improperly loaded cartridge and must immediately correct the condition before the improperly loaded cartridge continues the reloading process.

FIG. 5 shows that an overly filled cartridge creates a condition similar to that created by an under-filled cartridge. The probe 70 however is higher, thus placing the semi-circular groove 53 above the height of the locking balls 80. Nevertheless, the locking balls 80 cannot move inward because of the plunger 50, thus preventing the cartridge shell 8 from entering the housing 40. Once again, the operating handle will be stopped by the detent means prior to the completion of the handle cycle and the operator will immediately know of the presence of an improperly loaded cartridge.

To ensure that any pressure exerted on the powder 9 is minimized, it is preferred that the probe can be lifted completely within the locking sleeve 60 as shown in FIG. 5 so that the lower end of the probe is proximate to the lip 48. Otherwise, conceivably the primer (not shown) could be detonated by the large forces generated by the press.

Now that the function of the present invention is fully understood, one may better understand how to adjust the present invention for operation. To adjust the height of the housing 40 in the press 6, the locking nut 43 is turned so that it is moved near the top of the threaded portion 41 of the housing. The housing 40 is screwed onto the press frame 26 about halfway. The operator takes one of the cartridge shells 9 to be loaded and places it in the shell holder 10. Then, the operator will run the ram 20 upward until the cartridge shell 9 touches the lower surface of the locking sleeve 60. At that point, one merely must grab the top of the plunger 50 which is extending above the housing collar 46, and, while maintaining light upward force on the locking sleeve 60 with the operating handle 14, pull the plunger 50 up until the locking balls 80 enter the semi-circular groove 53. Now the cartridge case 8 will freely enter the housing 40, pushing the locking sleeve 60 and plunger 50. The operator will continue to bring the ram 20 to the top of its stroke and maintain it in that position. At this point, the housing 40 should be screwed downward until the housing lip is about to approach the shell plate 10. The shell plate 10 should be about 1/16 to ⅛ of an inch below the housing lip 48. Lastly, the locking nut 43 is turned so that it is positioned against the press frame 26, holding the present invention in place relative to the reloading press 6. The housing 40 is now in its vertically adjusted position.

The adjustment of the probe will now be illustrated. First, a resized and trimmed cartridge shell 8 will be filled with the proper amount of powder 9 desired. It should be placed in the shell holder plate 10 under the powder level sensing device. Once again, the operator should pull downward on the operating handle 14 so that the index groove 51 on the plunger rises above the housing collar 46. If the index groove 51 appears before the cartridge shell 8 touches the locking sleeve 60, the operator will know that the probe 70 and plunger 50 are too long and that the probe 70 must be screwed inwardly onto the plunger 50. If the cartridge shell 8 touches the locking sleeve 60 and the index groove 51 is not yet visible, the probe 70 must be screwed outwardly, so as to lengthen the plunger 50 and probe 70. The probe 70 can be screwed merely by holding the knurled section 55 of the plunger 50 with one hand and rotating the probe 70 with the other hand. The process is repeated until the index groove 51 is even with the top of the housing 40. At this point, the present invention is ready for operation.

When the present invention is mounted onto the press frame 26, but is not being used during the reloading process, a clip (not shown) can be affixed so that the device will remain in its uppermost position, thus disabling its action. This is added for those times when the press is being used for non-standard functions such as single stage loading, cycling a number of cartridges through to remove spent primers, or simply to re-crimp a batch of reloaded cartridges. The clip should have a very obvious indicator, such as a red tag, so that its presence cannot be easily overlooked.

An alternative means for warning the operator of an improperly positioned probe is a sensor for use on an automatic reloading machine. This would stop the driving motor rather than physically blocking motion. There are several standard sensors used for position measurement. This embodiment is easily adaptable to microswitches, electrooptical sensors, and Hall effect (magnetic) sensors. Each are readily available at low cost. The electrooptical sensor is recommended since it is fairly safe from emitting hazardous sparks.

Although this invention has been described in terms of certain preferred embodiments, other embodiments that are apparent to those of ordinary skill in the art are also within the scope of this invention. Accordingly, the scope of the invention is intended to be defined only by the claims which follow.

It is claimed:

1. An apparatus for detecting the presence of an insufficient or excessive amount of powder deposited in a cartridge shell and for preventing that improperly loaded cartridge shell from completing the loading process so that any defective condition can be corrected before a safety hazard results from that defectively loaded cartridge shell, comprising:

a housing adaptable to be mounted on a press frame having upper and lower sections where said upper section has an interior cross-sectional area less than the interior cross-sectional area at said lower section and having a downwardly facing sloping ramp on its interior surface at the change of the two cross-sectional areas;

a sleeve slidably inserted within said housing having a hole extending radially which is at least partially below the ramp when said sleeve is in its initial position;

a plunger slidably inserted within said sleeve having a groove thereabout;

a probe mounted on the lower end of said plunger; and a ball within said radial hole having a diameter so that it protrudes beyond the exterior surface of said sleeve when against said plunger and when said sleeve is in its initial position, and when said probe and sleeve are in proper relative positions with respect to each other upon the presence of a properly powder-filled cartridge shell, the ramp will force said ball toward the groove of said plunger so that said sleeve can move upward with said probe and plunger as the cartridge shell contacts and forces upwardly said sleeve, and when said probe and sleeve are not in proper relative positions, said ball cannot move toward the groove and thus is positioned against said ramp so that the sleeve remains in its initial position, thus preventing the entrance of the cartridge shell into said housing.

2. The apparatus of claim 1, wherein said housing has a collar to laterally support said plunger.

3. The apparatus of claim 1, further comprising a snap ring mounted to the lower end of said housing to retain said sleeve within said housing.

4. The apparatus of claim 1, wherein said plunger has an index groove so as to visually indicate when the powder deposited is irregular.

5. The apparatus of claim 1 further comprising a spring clip about said plunger which would hit the top surface of said sleeve so to prevent said plunger from sliding out of said housing and sleeve.

6. The apparatus of claim 2, further comprising a coil spring positioned between said sleeve and said housing collar to assist said sleeve to return to its initial position.

7. The apparatus of claim 1, wherein said probe fits within said housing upon the presence of excessive powder levels.

8. The apparatus of claim 1, further comprising a locking nut which would be screwed on the exterior of said housing until adjacent to the press frame.

9. The apparatus of claim 1, wherein said plunger and said probe are one integral piece.

10. An apparatus, for use with a device which deposits powder in a cartridge shell to produce ammunition, wherein the device has been set so that normally a predetermined quantity of powder is deposited, comprising:

a detector for measuring the quantity of powder deposited in a cartridge shell, said detector having a plunger and a probe mounted on the lower end of said plunger wherein said probe can be slidably inserted into the cartridge shell so that the height of said plunger and probe will be proportional to the quantity of the powder deposited;

means for comparing the measured quantity with the predetermined quantity said comparing means having a sleeve which contacts the cartridge shell and has a radial hole extending therethrough, and a groove in said plunger which is adjacent to said radial hole upon the presence of a quantity of powder substantially equal to the predetermined amount; and means for prohibiting the production of the ammunition when the detector has measured a quantity of powder not substantially equal to the predetermined amount, whether the amount deposited is insufficient or excessive, including a housing surrounding said sleeve with two cross-sectional areas and a ramp at the change of the two areas, wherein the ramp is at a position substantially above said radial hole when the sleeve is in its initial position, and a ball residing in the radial hole of said sleeve which protrudes beyond the outer surface of said sleeve as urged by said plunger and contacts the ramp of said housing, thus keeping the sleeve stationary in its initial position and the cartridge shell out of said housing upon the pressure of an improper amount of powder deposited in the cartridge shell.

11. An apparatus for detecting the presence of an insufficient or excessive amount powder deposited in a cartridge shell and for preventing that improperly loaded cartridge shell from completing the loading the process so that any defective condition can be corrected before a safety hazard result from that defectively loaded cartridge shell, comprising;

a housing having threads on its exterior surface so that it may be mounted on a reloading press frame and having upper and lower sections wherein said upper section has an interior diameter less than the interior diameter at said lower section and having a downwardly facing sloping ramp on the interior surface of said housing at the change of the two diameters;

a locking nut which mates with the exterior threads of said housing and holds the housing stationary relative to the press frame;

a sleeve slidably inserted within said housing having a plurality of holes positioned at least partially below the ramp when said sleeve is in its lowermost position;

a snap ring inserted near the lowermost end of said housing which maintains the locking sleeve within said housing;

a plunger slidably inserted within said sleeve having a groove thereabout and extending upwardly beyond the uppermost portion of said housing and having a threaded portion near its lower end;

a probe having a flat lower end and a threaded upper end threaded into said plunger threads;

a spring clip about said plunger and positioned above said sleeve so that said plunger remains in said housing;

a coil spring about said plunger and positioned above and adjacent to said sleeve so that said sleeve will be forced slightly downwardly notwithstanding the presence of friction between said sleeve and said housing; and a plurality of balls within said radial holes having a diameter so that said balls protrude beyond the exterior surface of said sleeve when against said plunger and when said sleeve is in its initial position, and when said probe and sleeve are in proper relative positions with respect to each other upon the presence of a properly powder-filled cartridge shell, the ramp will force said ball toward the groove of said plunger so that said sleeve can move upwardly with said probe and plunger as the cartridge shell contacts and forces upwardly said sleeve, and when said probe and sleeve are not in proper relative positions, said ball cannot move toward the groove and thus is positioned again said ramp so that the sleeve remains in its initial position, thus preventing the entrance of the cartridge shell into said housing.

12. A powder level sensing device to assist in the loading of ammunition, comprising:

a housing;

a sleeve slidably mounted in said housing;

a plunger slidably mounted in said sleeve and having one end extending out of said sleeve and adapted to sense a quantity of powder in a cartridge; and means for locking said plunger to said sleeve when said plunger has sensed a desired amount of powder in said cartridge so that the sleeve and plunger can move as a unit and permit the sleeve to enter and exit said housing.

13. The device of claim 12 wherein said locking means permits further movement of said plunger into said sleeve, beyond a desired position, into a position sensing an excessive amount of powder in said cartridge, and said locking means prevents movement of said sleeve into said housing when said probe is in said excessive position.

14. The device of claim 12 wherein said probe senses a quantity of powder in said cartridge less than the desired amount and thus does not reach a desired position, and said locking means prevents movement of said sleeve into said housing when said probe has sensed a quantity of powder less than the desired amount.

15. The device of claim 12 wherein said locking means limits movement of said sleeve into said housing when said plunger senses more or less than the desired amount of material in said cartridge, and thus prevents completion of the loading of the ammunition.

16. The device of claim 12 wherein said plunger is adapted to extend beyond said housing to provide a visual indication of the actual level of powder in said cartridge.

17. An improved apparatus for reloading a cartridge shell in which said apparatus drops a predetermined quantity of powder into the cartridge shell and seats a bullet onto the cartridge shell, wherein the improvement comprises:

a detector measuring the quantity of powder which has been deposited into the cartridge shell, said detector having a plunger which can be slidably inserted into the cartridge shell so that the height of said plunger will be proportional to the quantity of the powder deposited;

means for obstructing the seating of the bullet onto the cartridge when the quantity of powder deposited in said cartridge is either in excess or less than the predetermined quantity, said obstructing means including a housing and a sleeve with a radial hole, said housing having two cross-sectional areas and a ramp at the change of the two are as, wherein the ramp is at a position substantially above said radial hole when the sleeve is in its initial position; and a ball residing in said radial hole of said sleeve which protrudes beyond the outer surface of said sleeve as urged by said plunger and contacts the ramp of said housing, thus keeping the sleeve stationary in its initial position and the cartridge shell out of said housing upon the presence of an excessive or insufficient amount of powder deposited in the cartridge shell.

18. An apparatus for manually reloading cartridge shells allowing the cartridge shells to be subjected to repeated uses having a press frame with an upper and lower section, an operator's handle, a compound linkage, a drive shaft which moves upwardly through the lower section of the press frame by the compound linkage upon the exertion of force downwardly on the handle, a shell holder plate on the device shaft, a plurality of dies mounted on the upper section of said press frame into which the cartridge shells enter, a powder measure attached to the frame which deposits powder into the cartridge shell, and one die which seats a bullet on the cartridge shell, wherein the improvement comprises a die attached to the upper section of the frame which includes:

a detector for measuring the quantity of powder deposited into the cartridge shell; and means for obstructing the movement of the operator's handle and thus the entrance of the cartridge shell into the die when the quantity of powder deposited is not substantially equal to a predetermined amount including a housing, a sleeve slidably mounted in said housing, a plunger slidably mounted in said sleeve, and a means for locking said plunger to said sleeve when said detector has measured an amount of powder substantially equal to a predetermined quantity.

19. An improved method for reloading a cartridge shell, in which said method deposits a predetermined quantity of powder into the cartridge shell and seats a bullet onto the cartridge shell, wherein said improvement comprises:

sensing the quantity of powder in said cartridge by allowing a plunger to slide within a sleeve to contact said powder;

measuring the quantity of powder which has been deposited into said cartridge shell;

determining whether the quantity of powder deposited is substantially equal to the predetermined quantity;

locking said plunger to said sleeve when said plunger has sensed an amount of powder substantially equal to the predetermined amount so that the sleeve and plunger can move as a unit; and permitting said bullet to seat on said cartridge shell.

20. An improved method for reloading a cartridge shell, in which said method deposits a predetermined quantity of powder into the cartridge shell and seats a bullet onto the cartridge shell, wherein said improvement comprises:

sensing the quantity of powder in said cartridge by allowing a plunger to slide within a sleeve to contact said powder;

measuring the quantity of powder which has been deposited into said cartridge shell;

determining whether the quantity of powder deposited is substantially equal to the predetermined quantity; and locking said sleeve in position when said plunger has sensed an amount of powder not substantially equal to the predetermined amount so that the seating of the bullet onto said cartridge shell is obstructed, whether the quantity of powder is excessive or insufficient.

* * * * *